United States Patent [19]

Jeter et al.

[11] 4,314,510

[45] Feb. 9, 1982

[54] KINETIC SABOT SYSTEM

[75] Inventors: Thomas R. Jeter, Bel Air; William F. Donovan, Aberdeen, both of Md.

[73] Assignee: The United States of America as represented by the Secretary of the Army, Washington, D.C.

[21] Appl. No.: 115,819

[22] Filed: Jan. 28, 1980

[51] Int. Cl.[3] ..... F42B 3/16

[52] U.S. Cl. ..... 102/523; 244/3.23; 102/521

[58] Field of Search ..... 102/93, 520, 521, 522, 102/523; 244/3.23

[56] References Cited

U.S. PATENT DOCUMENTS

| | | | |
|---|---|---|---|
| 939,682 | 11/1909 | Gleason | 244/3.23 |
| 1,297,294 | 3/1919 | Edison | 244/3.23 |
| 4,177,733 | 12/1979 | Romer et al. | 102/93 |
| 4,249,465 | 2/1981 | Ballmann | 244/3.23 |

FOREIGN PATENT DOCUMENTS

| | | | |
|---|---|---|---|
| 990154 | 9/1951 | France | 102/93 |
| 2237169 | 3/1975 | France | 102/93 |

*Primary Examiner*—Harold J. Tudor

*Attorney, Agent, or Firm*—Nathan Edelberg; Robert P. Gibson; Max Yarmovsky

[57] ABSTRACT

Spin is imparted to a projectile within a smooth-bore barrel through the use of a projectile-sabot system. The sabot, which substantially encloses the projectile, has a forward flange section which includes a plurality of nozzles which cause the sabot to operate as a centrifugal turbine. The sabot has grooves or slots on interior and-/or exterior surfaces which fracture under the centrifugal forces which exist when the projectile-sabot system exits the smooth-bore barrel, thereby permitting the sabot to separate from the projectile after the desired spin has been imparted to the projectile.

14 Claims, 4 Drawing Figures

KINETIC SABOT SYSTEM

GOVERNMENTAL INTEREST

The invention described herein may be manufactured, used, and licensed by or for the Government for governmental purposes without the payment to us of any royalties thereon.

BACKGROUND OF THE INVENTION

1. Field of the Invention

The invention relates to a kinetic sabot system, and more particularly, to a sabot system for imparting spin to a projectile in a smooth-bore barrel.

2. Description of the Prior Art

The field of ballistic technology is replete with examples of many and varied methods of launching projectiles from tubes for the purpose of defeating a particular target. For the classical application requiring a high explosive shell, a cannon tube employing rifling, that is engraving lands and grooves to insure shell stability by the method of gyroscopic compensation is the most commonly employed. The gyroscopic compensation serves to negate the unfavorable aerodynamic static pressure distribution incurred with prior art devices. Such a "rifled" barrel, however, is unsuited to the launch of the modern finned kinetic energy projectiles since there is danger of fin damage due to propellant interference and impact in-bore. In addition, there is the possibility in free flight of Magnus problems, that is, invidious cross axis disturbances due to the attached fluid rotation and consequent pressure modification. The kinetic energy projectile is a critical requirement in the current armory and consequently the smooth-bore tube is the current selection for new weaponry.

SUMMARY OF THE INVENTION

The disadvantages of the systems of the prior art are overcome through the use of a projectile-sabot system by means of which, spin is imparted to the projectile within a smooth-bore barrel. The sabot, which substantially encloses the projectile, has a forward flange section which includes a plurality of nozzles which cause the sabot to operate as centrifugal turbine. The sabot has grooves or slots on interior and/or exterior surfaces which fracture under the centrifugal forces which exist when the projectile-sabot system exits the smooth-bore barrel, thereby permitting the projectile to separate from the sabot after the desired spin has been imparted to the projectile.

BRIEF DESCRIPTION OF THE DRAWINGS

The advantages of the invention will become apparent from the specification, particularly when read in conjunction with the drawings wherein.

DESCRIPTION OF THE PREFERRED EMBODIMENTS

Figure 1:
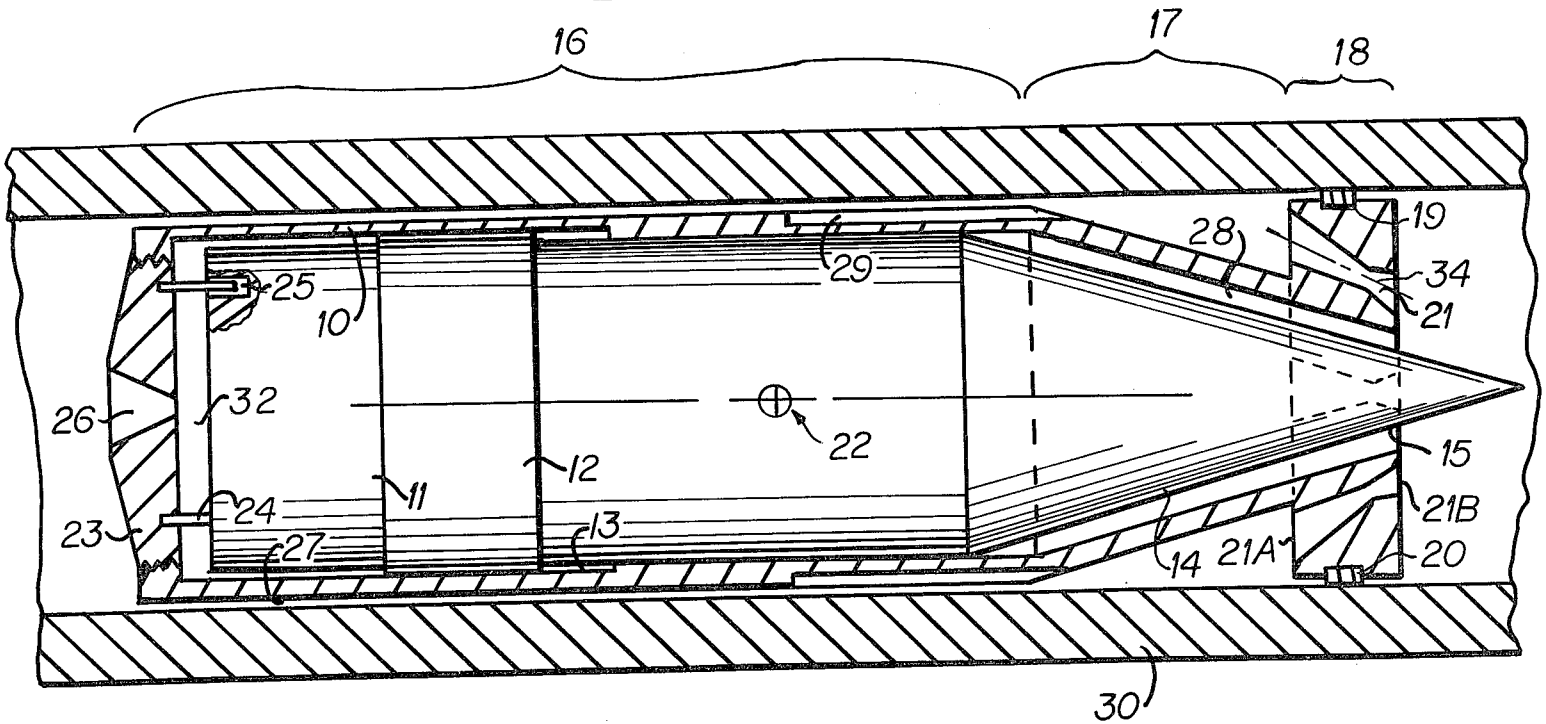
FIG. 1 is a fragmentary cross-sectional view of a round in a smooth bore barrel.
Figure 2:
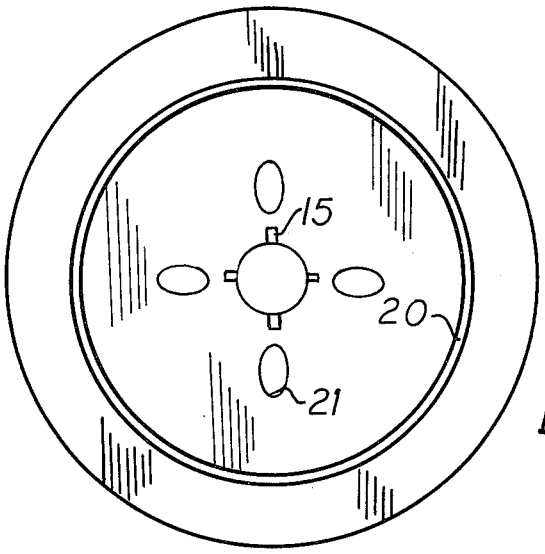
FIG. 2 is a front view of the round and barrel of FIG. 1.
Figure 3:
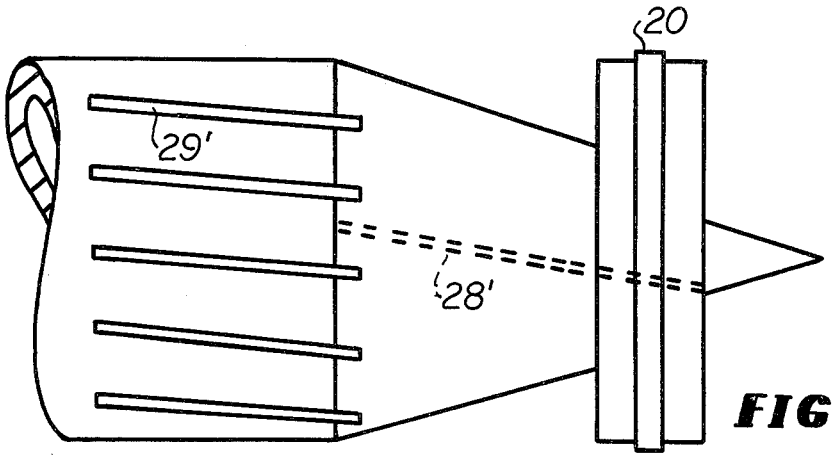
FIG. 3 is a fragmentary plan view of a modification of the round of FIG. 1.

For purposes of description, the round, consisting of projectile plus sabot, is assumed to have been inserted into the smooth-bore gun tube and fired in the conventional manner. This provides high pressure gas (60,000 to 100,000 psi at 5500° F.) in the region confined by the sealing surfaces of the round and produces acceleration of the total mass in accordance with Newton laws such that $F=ma$ where m = mass accelerated $F=p_e \times A$ = force $P_e$ = *effective pressure behind round (approximately* 0.8 × chamber pressure)

A = area exposed to pressure

The design consists of a sabot 10 enclosing a projectile 11 and aligning the projectile 11 within the sabot radially by sealing contact of the projectile rotating band 12 with the interior cylindrical sabot wall 13. This contact is so maintained to permit axial movement of the projectile within the sabot to that point where the bayonet engagement of the converging nose (conical, ogival or form factor configuration) 14 into the forward opening of the sabot 15 is attained. The projectile is thus secure radially and axially. The close fit of the seal surface 13 and the rotating band 12 will also permit torque transmission (for spin) in accordance with the classical requirement that Torque $=F_f \times r$ where r = radius of application $F_f$ = friction force $= u\ P_f A_f$ u = coefficient of static friction $P_f$ = radial contact pressure $A_f$ = contact area The sabot 10 consists of a cylindrical subcaliber exterior body section 16 with a tapering (conical) forward section 17 and an extended full-bore obturator/nozzle flange 18. The flange 18 carries recess 19 into which is fitted an obturator 20 of conventional construction well known to the art. The flange 18 also has a series of circumferentially spaced nozzles 21, whose axes are at a slight angle with respect to the sabot axis, and which consist of machined passages through which gas can flow under the pressure differences between the combustion and precurser regions of the round. It is to be emphasized that the center of gravity (C.G.) of the round 22 is most desirably located aft of the application of the nozzle gas force. The aft end of the sabot contains a base plug 23 threadably attached to the sabot 10, as an example, and contains driving pins or keys 24 engaging corresponding closed apertures 25 in the projectile. The base plug 23 is vented by means of a base plug vent 26 which is in communication with the combustion gas to allow pressure to apply to the aft end of the projectile. Ideally, the design would carry the condition that the pressure-force-acceleration of the sabot be naturally equally to that of the projectile; i.e., $$\text{acceleration}_{sabot} = \text{acceleration}_{projectile}$$

$$P_e A_s / m_s = P_e A_p / m_p$$

where $A_s$ = sabot area exposed to pressure $A_p$ = projectile area exposed to pressure $m_s$ = mass of sabot $m_p$ = mass of projectile The actual balance must include the net forces, of course, and admit the parasitic friction, precurser pressure and nozzle thrust into the final calculation. If this equality if not self-satisfying, the difference is assumed by the material stress in the sabot.

In operation, the round is axially accelerated within the smooth bore tube in the normal manner. Combustion pressure acts:

(1) around the base of the projectile to the contact seal and between the rotating band and the sabot;

(2) around the sabot to the obturator.

A close fit of the sabot cylindrical surface 27 within the smooth bore tube 30 provides an hydrodynamic bearing, the gas having a density of from 30 to 40 lbs/ft$^3$, which can support and align considerable unbalance. The inlet nozzle area exposed to the high pressure gas permits through flow and the conversion of gas energy to mechanical torque according to the Bernoulli and conservation relations:

$$\Delta H = dp/\rho = (u_2 V_{u2} - u_1 V_{u1})/g$$

where $\Delta H$ = gas enthalph change dp = d(p) derivative pressure expression $\rho$ = gas density = f(p)

$u_2$ = peripheral velocity of wheel at exit $V_{u2}$ = tangential component of absolute velocity of gas at exit $u_1$ = peripheral velocity of wheel at entrance $V_{u1}$ = tangential component of absolute velocity of gas at entrance g = gravitational acceleration constant.

This provides the torque to overcome the peripheral frictional resistance of the obturator and the windage losses of the round. The configuration preferably provides for a gas admission inlet diameter 21A greater than the gas discharge outlet diameter 21B. Further advantages of the design include the availability of maximum torque generation at the beginning of the round movement, when the resistance is greatest and a decrease in parasitic gas ejection as the round acquires velocity and thus a decrease in the relative velocity between round and gas. As the projectile exits the muzzle with a spin (depending on size) of from 50,000 to 100,000 revolutions per second, the sabot forward section 17 fractures from centrifugal force along lines of the internally interrupted radial slots 28, easily obtained by broaching into this region. Peeling of the sabot segments progresses instantaneously along the external surface scores 29 in sections 16 and 17, thus freeing the projectile 11 for free flight. Alternatively, the radial slots 28 and scores 29 are helically broached to match the rotation of the sabot. Residual high pressure gas in the aft cavity 32 blows the base plug 23 clear and the projectile 10 is unencumbered.

While the foregoing description illustrates specifically, a shell having a conical forward section, the application is general and the sabot system is also applicable to shaped charges, mass penetrators and other shell configurations requiring spin and particularly those where a preselectable spin configuration is desired.

Figure 4:
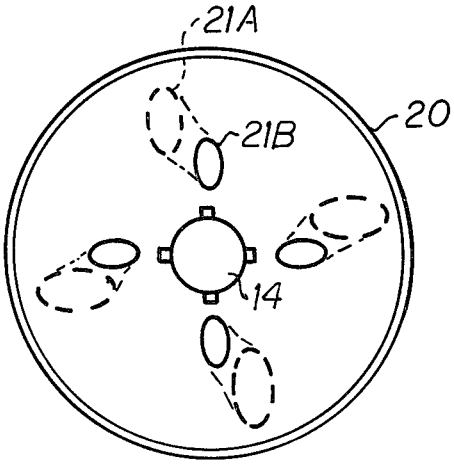
FIG. 4 is a front view of another modification of the round of FIG. 1.

The nozzle's axis 34, as previously noted, forms an acute angle with the longitudinal axis 36 of the projectile 11 with opposing pairs of nozzles 21 having their axis lying in a common plane which includes the longitudinal axis of the projectile. Alternatively, as illustrated in FIG. 4, the axis of each nozzle can be offset at a slight angle to said plane so as to further impart controlled rotational motion to the sabot.

We claim:

1. A kinetic projectile-sabot system for use in a smooth bore barrel comprising:

a projectile having a rotating band operatively positioned aft of its center of gravity and positioned intermediate to a conically shaped nose end, and a rear end having a plurality of closed apertures disposed therein;

sabot means, having a body section slidably disposed in said barrel and separated therefrom by a predetermined clearance, said clearance, in combination with propellant gases of said projectile providing a fluid dynamic bearing to assist in the guidance of said projectile-sabot system within said barrel, a conically shaped forward section disposed intermediate said body section and a full bore obturator-nozzle flange means in combination and substantially enclosing said projectile, said flange section being substantially the forward most section of said projectile, said flange having a plurality of nozzles extending from the forward surface of said flange section to the aft surface of said flange section for providing obturation and spin to said projectile-sabot system; and sabot base plug means for transferring torque generated by said obturator-nozzle flange means to said rear end of said projectile, for longitudinally sliding said nose end of said projectile into contact with said conically shaped forward section of said sabot means to axially align and radially secure said projectile within said sabot means, for allowing gas pressure to apply an accelerating force to the aft end of said projectile, and for stripping said base plug means and said sabot means from said projectile after said projectile-sabot system has exited from said barrel;

friction means for providing frictional engagement between said sabot body section and said rotating band of said projectile, and for restraining the longitudinal movement of said projectile toward said obturator-nozzle flange means.

2. The projectile-sabot system of claim 1 wherein said sabot means further includes:

a plurality of longitudinal scores disposed on the external surface of said body section; and an interior cylindrical wall seal surface operatively sized to permit sliding contact with said rotating band.

3. The projectile-sabot system of claim 2 wherein said sabot means includes:

a cylindrical body section having a plurality of longitudinal scores helically oriented at an angle matching the inflight rotational angle of said sabot means; and said forward, body and flange sections of said sabot means in combination substantially enclosing said projectile, said flange section positioned substantially forward of the center of gravity of said projectile-sabot system.

4. The projectile-sabot system of claim 3 wherein said sabot means further includes:

a plurality of longitudinal grooves on an internal surface of said conically shaped forward section of said sabot means.

5. The projectile-sabot system of claim 4, wherein said forward section of said sabot has a forwardly decreasing diameter substantially matching the decreasing diameter forward end of said projectile, and wherein said internal surface longitudinal grooves extend from the forward surface of said flange section to the aft end of said forward section of said sabot.

6. The projectile-sabot system of claim 5, wherein said internal surface longitudinal grooves are helically oriented at an angle matching the in-flight rotational angle of said sabot.

7. The projectile-sabot system of claim 6, wherein each of said nozzles have an inlet diameter which is larger than its outlet diameter.

8. The projectile-sabot system of claim 7, wherein said nozzles have a region intermediate their inlet end and outlet, which region has a diameter which is less than the outlet diameter.

9. The projectile-sabot system of claim 8, further comprising an obturator groove positioned circumferentially in the outer surface of said flange section and obturator means in said obturator groove.

10. The projectile-sabot system of claim 9 wherein said sabot base plug means is threadedly affixed to the aft end of said sabot body section which includes;

vent means for allowing propellant gas pressure to be applied to an aft cavity in the aft end of said projectile during launch of said projectile-sabot system, and for blowing said base plug means clear and free from said projectile when said projectile-sabot system exits from said barrel.

11. The projectile-sabot system of claim 10, wherein said vent means of said base plug means includes an externally threaded plug having a centrally disposed passage therein having a forwardly decreasing diameter providing high flow resistance in the reverse direction.

12. The projectile-sabot system of claim 11, further comprising fracture means, whereby said sabot fractures in-flight along predetermined lines due to centrifugal forces.

13. The projectile-sabot system of claim 12, wherein said fracture means includes said longitudinal scores on the external surface of said body section of said sabot.

14. The projectile-sabot system of claim 12, wherein said fracture means includes said longitudinal grooves on the internal surface of said forward section of said sabot.

* * * * *